US006109334A

United States Patent [19]

Phipps

[11] Patent Number: 6,109,334

[45] Date of Patent: Aug. 29, 2000

[54] METHOD OF STATIC CASTING COMPOSITE BRAKE DRUM

[75] Inventor: David W. Phipps, Chattanooga, Tenn.

[73] Assignee: North American Royalties, Inc., Chattanooga, Tenn.

[21] Appl. No.: 08/895,006

[22] Filed: Jul. 15, 1997

[51] Int. Cl.[7] ..... B22D 19/00

[52] U.S. Cl. ..... 164/103; 164/105; 164/112

[58] Field of Search ..... 164/9, 10, 11, 164/98, 105, 104, 103, 112

[56] References Cited

U.S. PATENT DOCUMENTS

| | | | |
|---|---|---|---|
| 1,576,317 | 3/1926 | Eklind | 164/105 |
| 1,943,224 | 1/1934 | MacLennan | 164/112 X |
| 2,044,815 | 6/1936 | Sargent | 164/103 |
| 2,111,709 | 3/1938 | Van Halteren | 188/218 R |
| 2,153,364 | 4/1939 | Campbell . | |
| 2,218,810 | 10/1940 | Campbell et al. | 164/98 |
| 2,273,614 | 2/1942 | Batie | 164/103 |
| 2,316,029 | 4/1943 | Van Halteren et al. . | |
| 3,429,364 | 2/1969 | Wonus | 164/112 X |
| 3,841,448 | 10/1974 | Norton, Jr. | 188/218 R |
| 4,436,139 | 3/1984 | Strader | 164/112 |
| 4,858,731 | 8/1989 | Bush | 188/218 R |
| 5,138,757 | 8/1992 | Ball et al. . | |
| 5,285,874 | 2/1994 | Revyn | 188/218 R |
| 5,345,672 | 9/1994 | Ball et al. | 29/715 |

FOREIGN PATENT DOCUMENTS

| | | | |
|---|---|---|---|
| 633172 | 12/1961 | Canada | 164/112 |
| 56-148463 | 11/1981 | Japan | 164/103 |
| 617128 | 2/1949 | United Kingdom | 164/112 |

*Primary Examiner*—J. Reed Batten, Jr.
*Attorney, Agent, or Firm*—Miller & Martin LLP

[57] ABSTRACT

A mold with a cylindrical sidewall, is provided. A shell is positioned around the sidewall. The shell is heated to between 500 and 1,000 F. Molten iron alloy between 2550 and 2650° F. is poured into the mold. The resulting composite brake drum is cooled and cleaned. The method of casting includes positioning a brake drum shell around a mold defining a cavity interior of the shell, heating the shell, pouring molten iron alloy into the mold to fill the cavity and cooling and cleaning the composite brake drum.

20 Claims, 7 Drawing Sheets

METHOD OF STATIC CASTING COMPOSITE BRAKE DRUM

This invention relates to the manufacture of composite brake drums having a steel outer casing and an inner cast iron surface.

BACKGROUND OF THE INVENTION

Brake drums are subjected to relatively high pressures and high temperatures in service. Iron alloys are particularly suited to provide braking action in contact with the lining of brake shoes, but are relatively weak. There have been many proposals for strengthening brake drums, the most successful of which is described in Van Halteren, et al., U.S. Pat. No. 2,316,029, and involves centrifugally casting an iron alloy liner into a steel shell of the desired shape. Centrifugal casting, however, is relatively expensive and time consuming compared to static casting processes such as sand casting. In addition, centrifugal casting requires special equipment which places limitations on the shape of the steel shell in order to fit on the turntable of the centrifugal casting machinery. In addition, the heat and centrifugal forces involved in centrifugal casting may combine in some cases to cause the cast brake drum to go slightly out-of-round. Therefore, centrifugally cast liners must be made thicker than desired for purely functional reasons in order to provide sufficient machining material to correct the out-of-round condition.

Other attempts to develop composite brake drums having the high strength of steel but the metallurgical characteristics of cast iron on the inner friction surface are represented in Norton, U.S. Pat. No. 3,841,448 which discloses an encircling steel band and Bush, U.S. Pat. No. 4,858,731 which has an embedded steel wire framework.

The wire framework of Bush has proved of little assistance as the steel wires must be of small diameter so that the steel wires will heat and expand at nearly the same rate as the cast iron surrounding them. In practice, the stresses applied from the brake shoes acting on the drum are placed largely on a single strand of the reinforcing steel wire—until that wire breaks. Then the stresses are placed on an adjacent wire until it similarly fails, and this process is repeated until the entire reinforcing framework is broken. Similarly in Norton, the reinforcing band does not offer the reinforcing strength of a complete steel shell or an inward steel flange for attachment to a wheel or bonnet.

OBJECT OF THE INVENTION

It is therefore an object of the invention to provide a method for manufacturing composite brake drums by static casting, faster and less expensively than current centrifugal casting processes.

It is another object of the invention to provide a method of making steel shell brake drums with cast iron friction liners which will permit a wide variety of shell shapes.

It is yet another object of the invention to provide a method of manufacturing composite brake drums with greater precision, and requiring less finish material to balance.

It is a further object of the invention to improve the balance of composite brake drums by utilizing static casting.

DETAILED DESCRIPTION OF THE INVENTION

Drum brakes are commonly used on the rear of cars with front disk brakes. They are used on all four wheels in early-model cars. The drum brake stops the rotating drum and wheel through friction between an anchored brake shoe and the revolving drum. The energy of motion of the vehicle is converted into heat that is dissipated by the brake drum and related parts. Steel shelled or composite brake drums provide additional strength and are primarily employed in heavy duty applications such as on tractor trailer rigs and off road heavy equipment. Steel shelled brake drums also provide enhanced safety by preventing brake drum explosions and may be desirable in other types of vehicles for safety reasons.

A discussion of the general operation of a drum brake will be helpful in understanding of the significance of the present invention.

Figure 1:
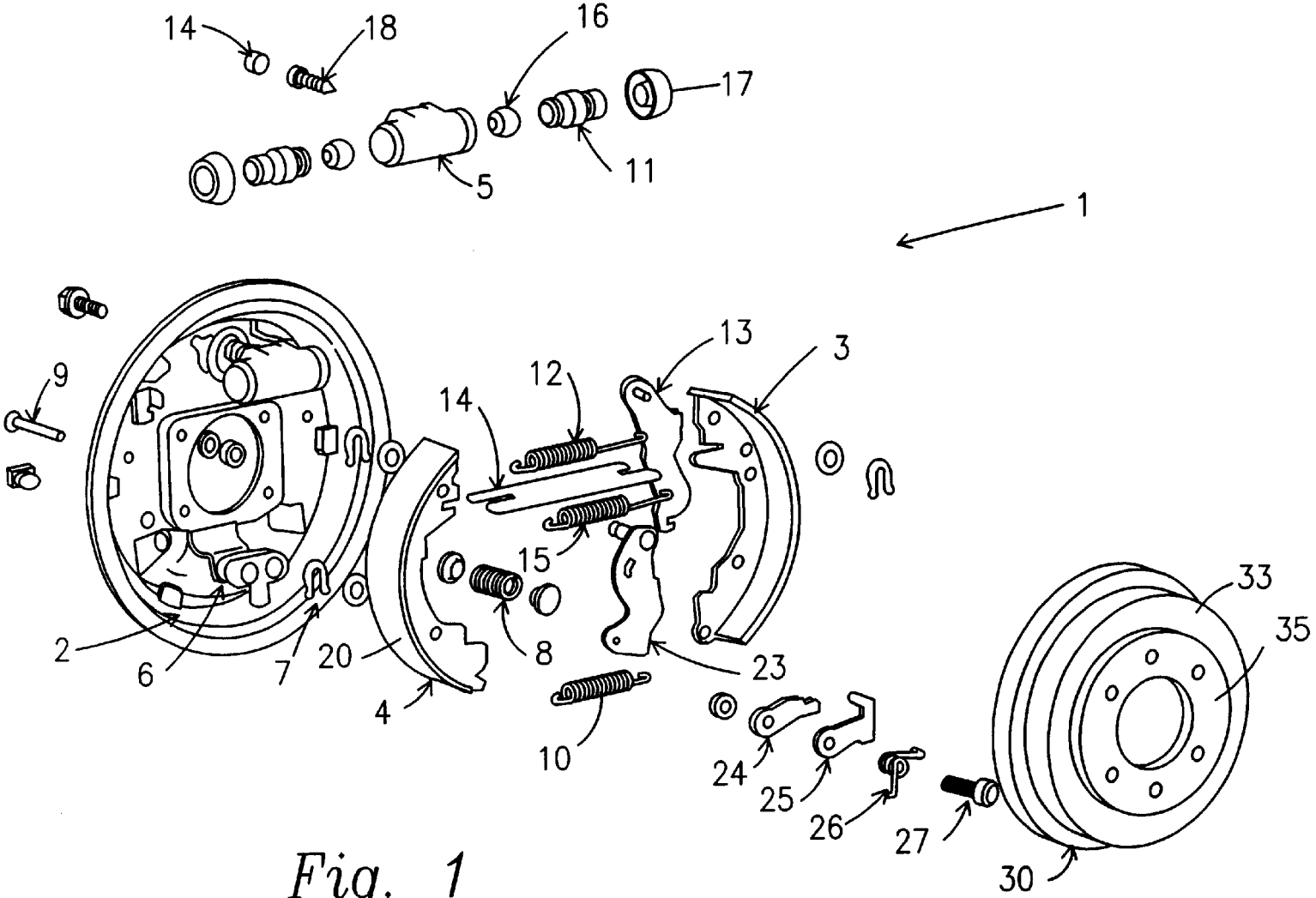
FIG. 1 is an exploded perspective view of a drum brake assembly.

The parts of a rear wheel brake drum assembly 1 are shown in exploded view in FIG. 1. Each brake unit consists of a backing plate 2, a primary 3 and secondary brake shoe 4, brake shoe retaining pins and springs, return springs, parking brake cable and linkage, automatic adjuster components, an adjuster screw assembly, a hydraulic wheel cylinder 5, and a brake drum 30.

The brake components are mounted on the backing plate 2, which is bolted to the rear axle housing flange, or to the front steering knuckle (not shown). An anchor pin 6 mounted at the top or bottom of the backing plate 2 works as the brake shoe locating member and pivot point.

The primary brake shoe 3 is installed in the leading position facing the front of the vehicle. The secondary brake shoe 4 is installed in the trailing position facing the rear of the vehicle. The brake shoes 3, 4 are identified by their respective lining thicknesses and length. In many designs, the primary brake shoe lining is thinner and slightly shorter than the secondary shoe lining.

Each brake shoe 3, 4 is attached to the backing plate 2 by a retaining pin 7, hold down spring 8, and pin retainers. The lower ends of the brake shoes 3, 4 are fitted to the backing plate anchor pin 6 and are held in position by the brake shoe return spring 10. The upper ends of the brake shoes 3, 4 fit into the wheel cylinder pistons 11 and are held together by the shoe-to-shoe spring 12. The parking brake lever 13, strut 14 and strut-to-shoe spring 15 are attached to the top of the two brake shoes 3, 4. The automatic adjuster components are mounted on the secondary brake shoe 4. When brakes are applied, hydraulic pressure from the master cylinder 5 is applied to the wheel cylinder pistons 11. The hydraulic pressure against the pistons 11 forces the brake shoes 3, 4 against the brake drum 30. When the brake pedal is released, the shoe return springs 10 pull the brake shoes 3, 4 back to the released position.

The wheel cylinder 5 is made from cast iron or aluminum. Two aluminum pistons 11 are positioned at either end of the cylinder bore. Two rubber cups 16, separated by a spacing spring (not shown), seal the hydraulic pressure.

When the brakes are applied, fluid enters the center of the wheel cylinder 5. The pressure is sealed by the rubber cups 16. As the pressure builds up, the pistons 11 are forced outward. Linkage from the pistons 11 is used to push the brake shoes 3, 4 in contact with the inner friction surface of the drum 30. When the brakes are released, the brake shoe retracting springs 10, 12 force the pistons 11 back into their bores. A rubber boot 17 at each end of the cylinder 5 prevents dirt from entering. A bleeder valve comprised of a bleeder screw 18 and cap 19 is located in the cylinders to bleed out air.

Brake shoes are the parts that support the brake lining 20. The lining is either riveted or bonded to the face or table of the shoe 3, 4. The face is formed to fit the contour of the inner friction surface of the drum 30. The force to push the brake shoes 3, 4 against the drum 30 is created by the applied force of the wheel cylinder 5 and the movement of the shoes 3, 4 within the drum 30.

The movement of the shoes 3, 4 within the drum 30 is used to help apply the brakes. This is called the self-energized or brake servo action. To understand how self-energized brakes work, refer to FIG. 2 and consider that a brake shoe 3, 4 that is free to move within the brake drum 30 would start to move with the drum 30 when brought into contact with it unless it were held in some manner. There would be no braking action because there would be no resistance to cause friction. The brake shoe has to be held to keep it from turning with the rotation of the brake drum.

The anchor pin 6 on the brake backing plate 2 keeps the shoe from turning with the drum 30. The frictional force tries to turn the shoe 4 around the anchor pin 6. As a result, the shoe 4 is pulled tighter against the drum 30 with a force greater than the applied force that first moved the shoe against the drum. This is called self-energized action.

When two shoes 3, 4 are connected by an adjusting link 22 with some type of anchor pin at the top, the applied force acts on one shoe 3, moving it into drum rotation (shown by arrow 21) and energizing the shoe through the action of the drum 30. Because the shoe starts the movement, it is called the primary shoe 3; the other shoe is called the secondary shoe 4.

Figure 2:
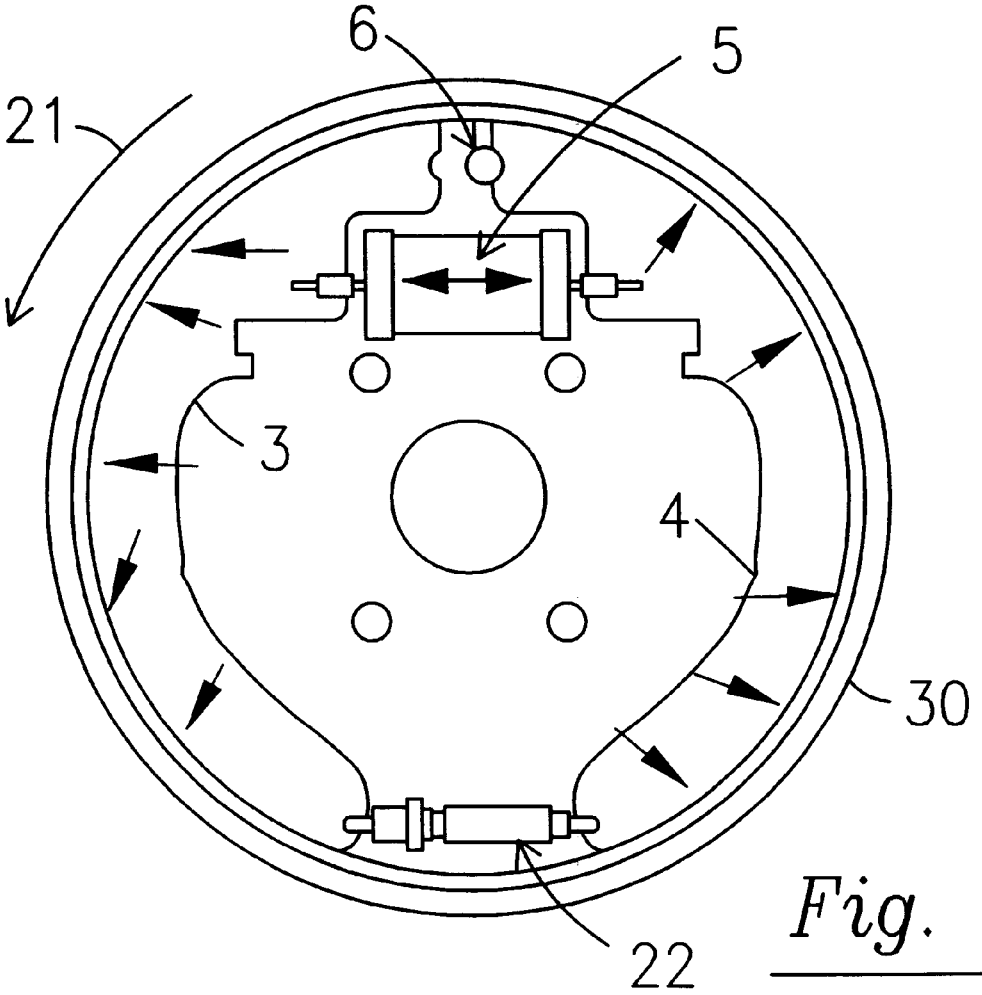
FIG. 2 is a simplified cutaway side view of a brake drum showing the forces applied during braking.

The greater pressure or force applied to the secondary shoe 4 is again increased by the action of the drum 30 if the shoe pivots on the anchor 6. Therefore, the braking efficiency of the secondary shoe 4 is greater than that of the primary shoe 3 through self-energized action. The action of both shoes 3, 4 has a tendency to force them tighter into the drum 30 as they are both energized by drum rotation as shown in FIG. 2.

Drum brakes also have an automatic adjuster. The automatic adjuster mechanism maintains correct operating clearance between the brake lining and the brake drum by adjusting the brake shoes in direct proportion to lining wear. The shoes 3, 4 are linked together opposite the anchor 6 by an adjuster screw assembly 22 and a spring. The adjuster 22 holds them apart. The spring holds them against the adjuster ends. Often a wheel with teeth called a star wheel, is used to manually or automatically turn the adjuster screw assembly. Making the adjuster screw assembly longer by unscrewing it brings the shoes 3, 4 in closer contact with the drums 30. The adjuster spring bears against the star wheel teeth providing a ratchet lock. A slot in the backing plate 2 gives access to the star wheel.

As a result of the enormous forces generated by not only the action of the wheel cylinder 5, but also the self-energized action, brake drums 30 are subject to considerable stress. In addition to pressure, the friction between the brake shoe lining 20 and the interior of the brake drum generates enormous heat. As brake drums have come to be used on faster and larger vehicles, and particularly bomber aircraft in use during World War II, cast iron brake drums were strengthened by centrifugally casting the iron alloy brake drum inside a steel reinforcing shell. Cross-sections for such steel shelled composite brake drums are pictured in FIGS. 3AD. Each drum has a steel outer reinforcing shell 31 and an inner cast iron section 32 with friction surface 35. The steel shell 31 has an inward flange 33 at flange end 39, a cylindrical section 34, and open end 38. As shown in FIG. 1, the inward flange 33 may be configured with a mounting section or bonnet 35 to attach to the vehicle wheels.

Figure 3A:
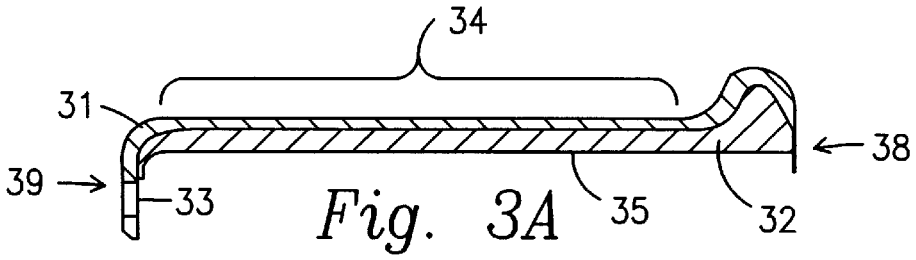
FIGS. 3A through D are cross-sectional views of sections of prior art composite brake drums that have heretofore been manufactured by centrifugal casting processes.
Figure 3B:
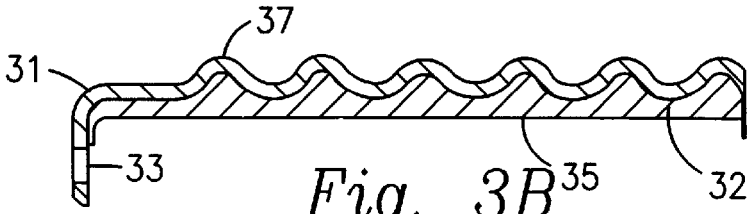
Figure 3C:
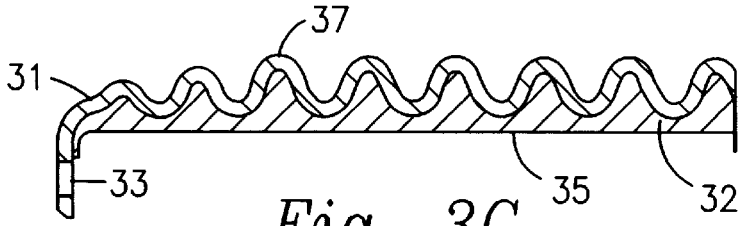
Figure 3D:
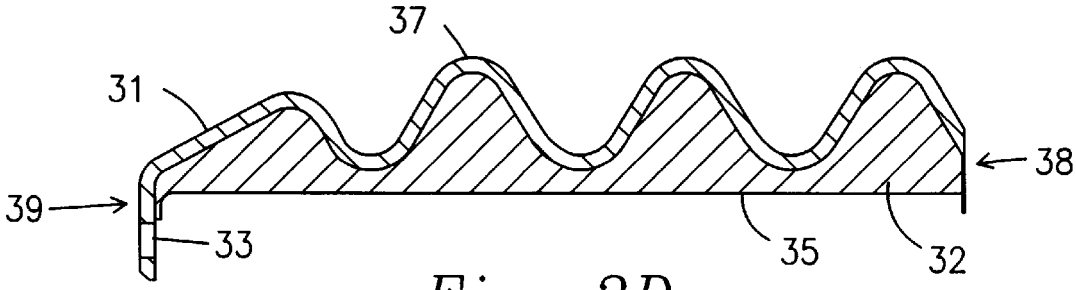

The first steel brake drum shells had relatively plain cylindrical sections 34 as pictured in FIG. 3A. Subsequently, ribs 37 were added to the cylindrical section 34 as shown in FIG. 3B. The brake drums were further strengthened by making the ribs 37 deeper as shown in FIGS. 3C and 3D.

At the time the composite steel shelled brake drums were developed, it was believed necessary to use centrifugal casting in their manufacture for two primary reasons. First, it was not possible to machine the reinforcing ribs into steel shelled drums. Machining ribs into cast iron drums was the preferred method due to molding problems and casting stresses encountered when casting ribs directly. Second, it was believed necessary to utilize centrifugal casting process to improve the bond between the cast iron friction liner and the outer steel shell.

Centrifugal casting is relatively complex, time consuming, and expensive compared to static casting techniques. Because the centrifugal casting equipment must be specifically configured for each size and shape of steel shell, the centrifugal casting process does not permit for easy changes in the design of the steel reinforcing shell 31. In addition, due to the design of existing centrifugal casting equipment, the configuration of the inward flange 33 at the front end of the brake drum is limited, and cannot be readily reconfigured to match new wheel designs.

Figure 4A:
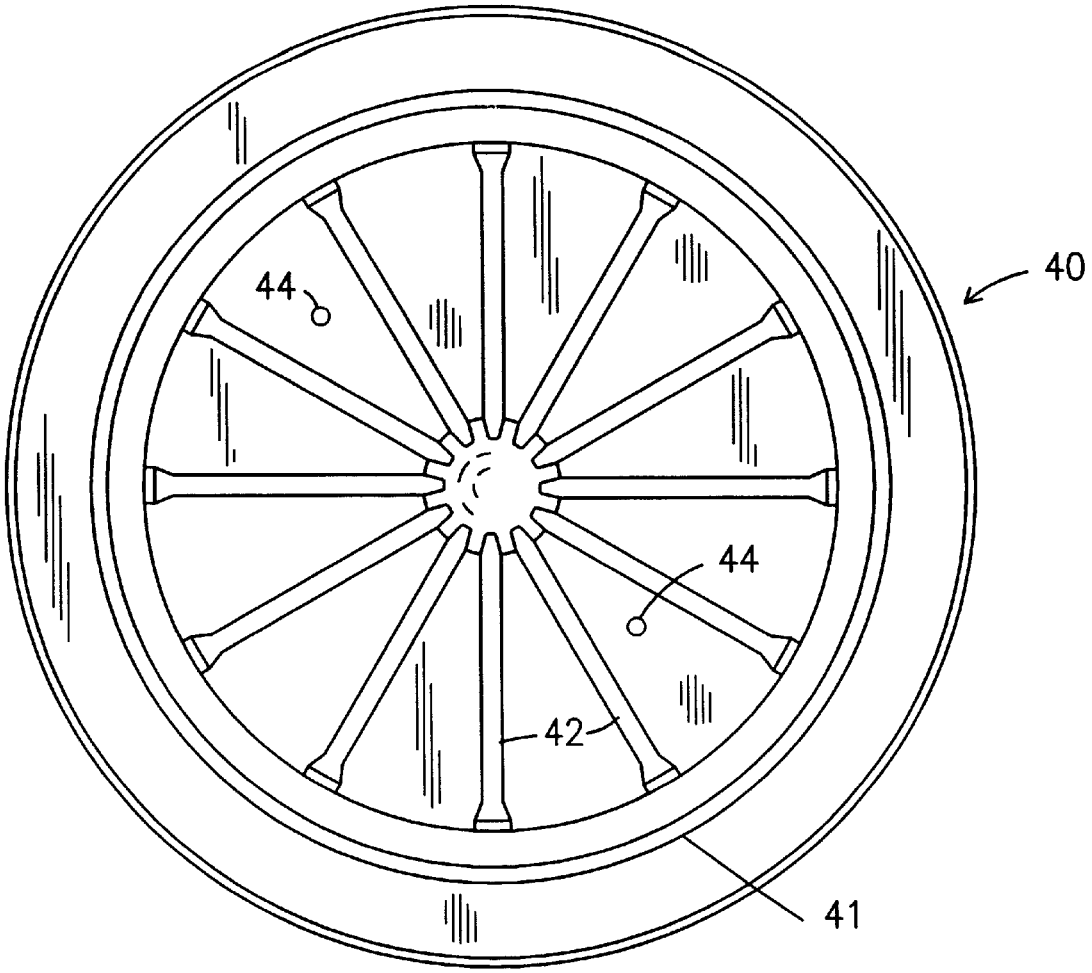
FIG. 4A is a top plan view of the base core of a sand mold used to cast composite brake drums according to the method of the present invention.
Figure 4B:
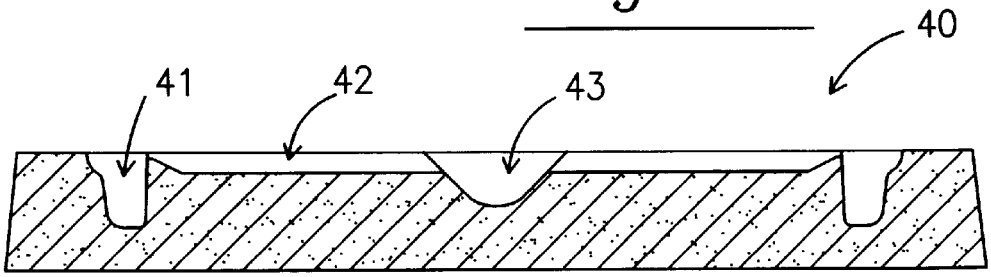
FIG. 4B is a cross-sectional side view of the base core of FIG. 4A.

The present invention utilizes a sand core, preferably in two parts, to enable the static casting of composite brake drums having a steel reinforcing shell and a cast iron interior friction surface. Turning to FIGS. 4A and 4B, the bottom or base core 40 is illustrated. The base core 40 features a mounting ring such as circular channel 41 designed to receive the open end 38 of steel shell 31 which is opposite the flange 33 end of the shell. In gates 42 radiate from a turbulence chamber 43. Also shown are apertures 44.

Figure 5A:
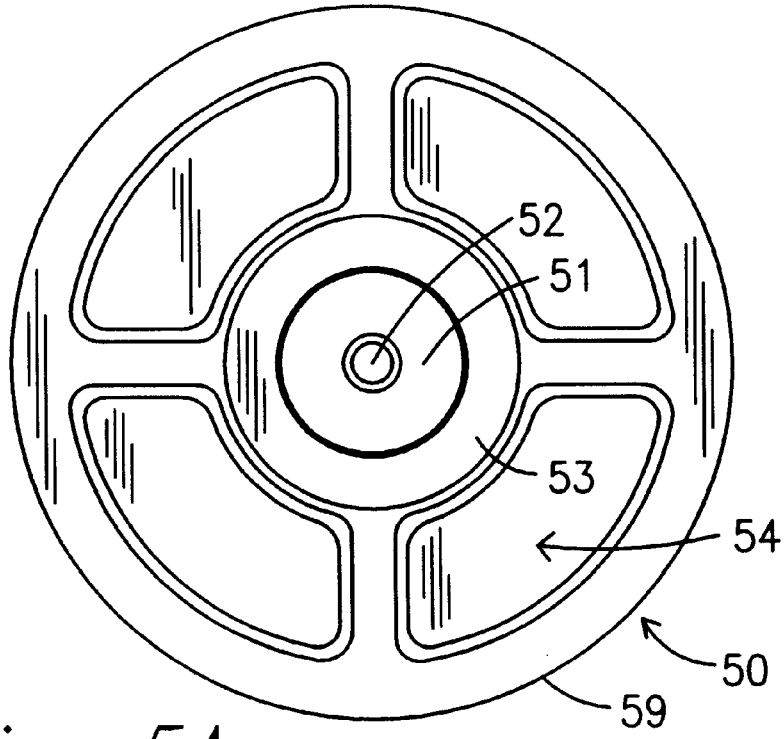
FIG. 5A is a top plan view of the top core of a sand mold used to cast composite brake drums according to the method of the present invention.
Figure 5B:
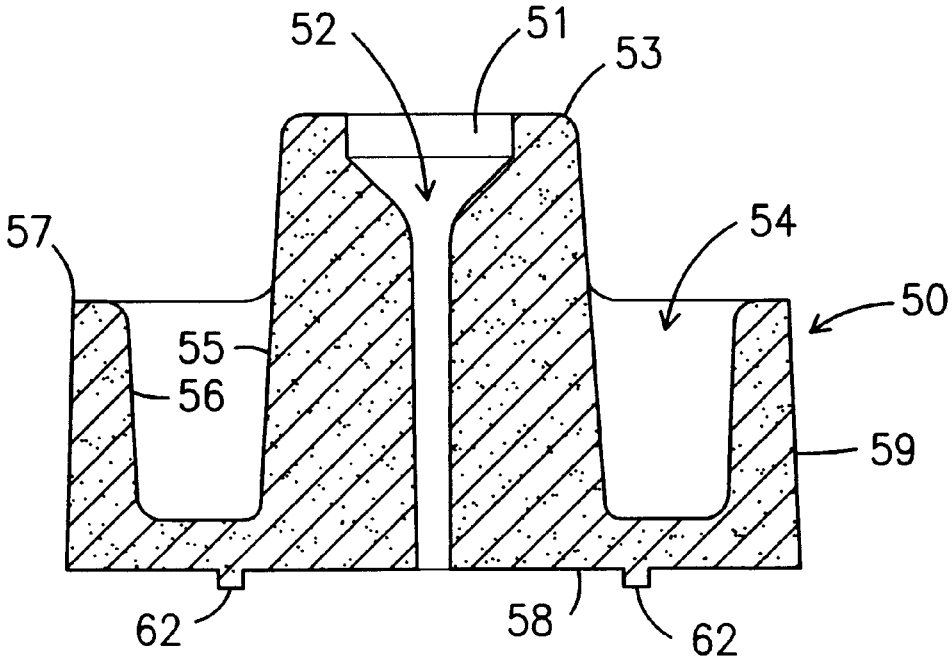
FIG. 5B is a cross-sectional side view of the top core of FIG. 5A.

FIGS. 5A and 5B show an embodiment of a top core So used in conjunction with base core 40 in casting steel shelled composite brake drums. The top core 50 features a pouring cup 51 and down sprue 52 proceeding from upper plateau 53 through top core 50 and emerging from the bottom 58. The top core 50 also preferably has an inner wall 55 and outer wall 56 defining a cavity 54. When cavity 54 is open to the top as illustrated in FIG. 5B, it may act as a repository for any molten iron that splashes out of the pouring cup 51. However, when an automatic pouring device is used, such as Opti-Pour available from ABB, there is minimal splashing.

Outer wall 56 has an upper shoulder 57 which is designed to lie under the inward flange 33 of steel shell 31 (as pictured in FIG. 6) and cylindrical side wall 59 that will define the inner friction surface 35 of the cast steel shell brake drum. It will be understood that the upper shoulder 57 preferably has a plurality of gas vents (not shown) which would typically consist of approximately six depressions in the upper shoulder 57 about 1 mm in depth and 25 mm in width. Also shown in FIG. 5B are plugs 62 which are sized to be received in apertures 44 of base core 40 before casting.

Figure 6:
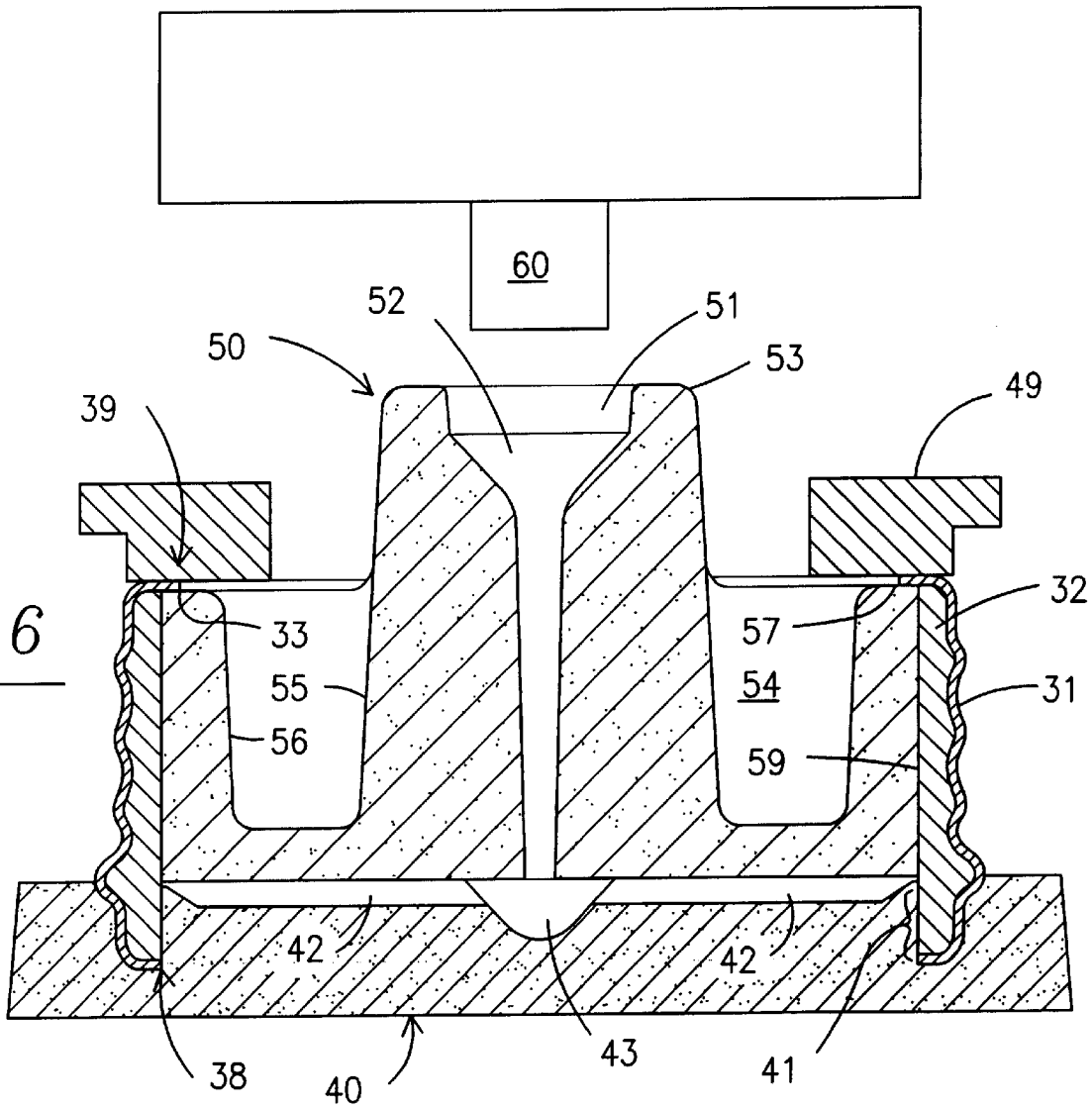
FIG. 6 is a cross-sectional side view of the sand core pieces of FIGS. 4 and 5 and steel shell in position after casting a composite brake drum according to the present invention.
Figure 7:
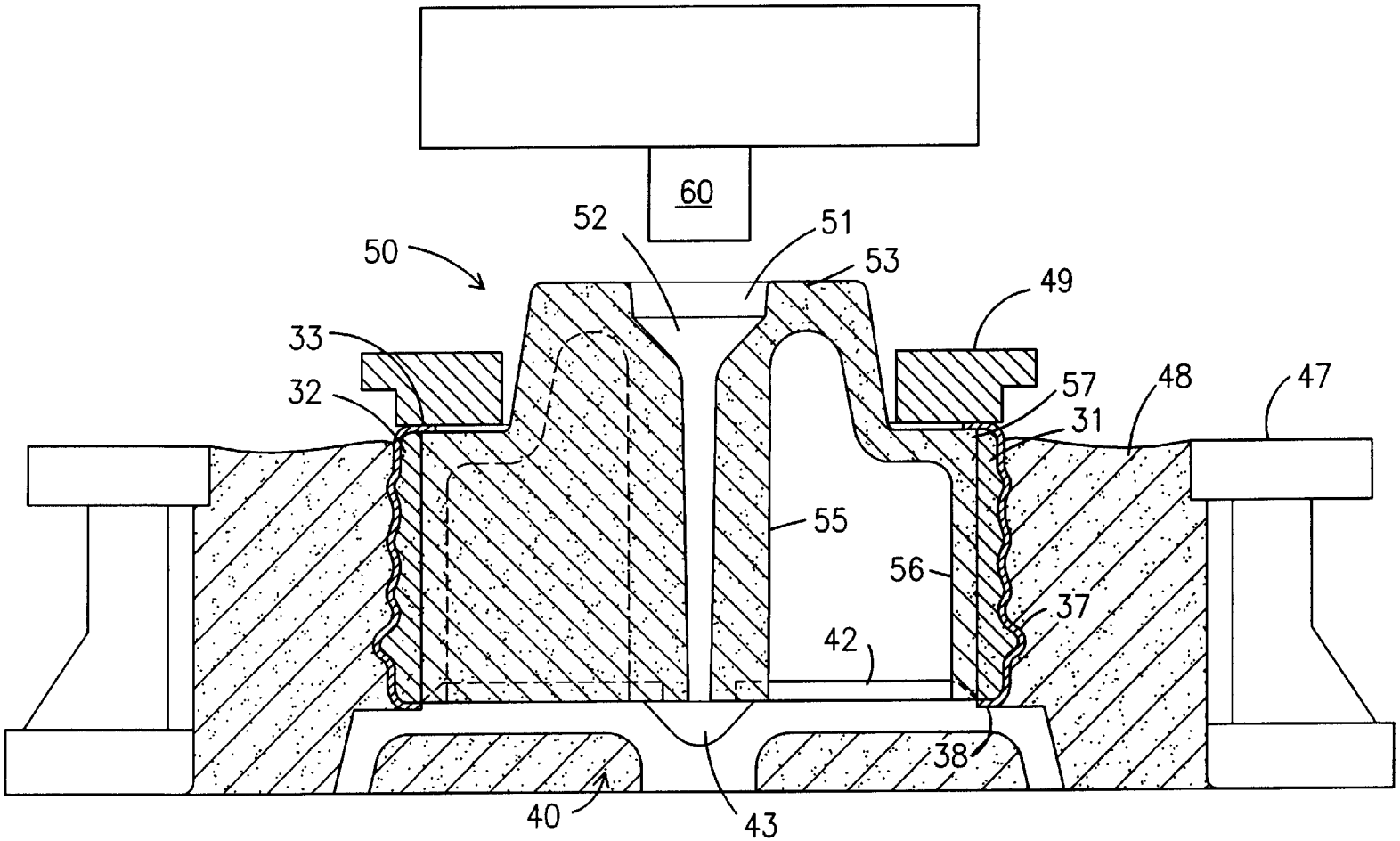
FIG. 7 is a cross-sectional side view of alternative top and base core pieces for practicing the preset invention, which realigns the in gate to the bottom of the cavity and utilizes a sand and flask arrangement.

FIG. 6 shows the entire assembly immediately after casting. First, the cores 40 and 50 have been interlocked and shell 31 has been mounted about the cylindrical side wall defined by outer wall 59 and the inner wall of channel 41. Illustrated is the pouring spout 60 through which molten iron (typically heated to about 2550°–2650° F.) is introduced into pouring cup 51 and downward sprue 52 and thence proceeds through top core 50 downward into turbulence chamber 43 of the bottom core 40. From that point, the gravitational forces on additional molten iron coming downward through sprue 52 push molten iron in basin 43 out the in gates 42 to the circular channel of the base core 40. Preferably the in gates are positioned as shown in FIG. 6 at the thickest portion of the cast iron liner 32 and near the bottom or open end 38 of the shell 31 to provide the best fill for the mold created by base core 40, top core 50 and shell 31. Near the open end 38 of steel shell 31, molten iron flows into steel shell 31 and fills the cavity defined between the inner surface of steel shell 31 and cylindrical sidewall 59 of the top core 50 resulting in a cast iron friction liner 32. optionally as shown in FIG. 7, sand 48 may be placed surrounding the steel shell 31 and retained in place by flask 47. FIG. 7 also shows the positioning of in gates 42 at the bottom of open end 38 of shell 31. While this configuration minimizes turbulence within the cavity during casting, it does not provide the best fill for the thickest rib portions 37. The sand 48 and flask 47 assembly is utilized primarily to slow the cooling of the cast liner 32. This has generally not proven necessary.

Although inward flange 33 of steel shell 31 in FIGS. 6 and 7 is of standard appearance, the wide variety of options available in designing the connection between upper plateau 53 and outer shoulder 57 permits wide design latitude in the shape of flange 33. Shell 31 may even be formed with mounting shoulder 35 (shown in FIG. 1) prior to casting the iron liner 32. It is generally only necessary that the flange end 39 maintain an opening of about three inches in diameter to permit a pouring cup 51 of approximately 1.5 to 2 inches in diameter and a half inch inner wall 55 on either side of cup 51. Optional weight 49 may be configured as required by the shape of inward flange 33.

Although flux is utilized in the centrifugal casting composite brake drums, the use of flux should be minimized in static casting. The use of flux is designed to promote a bond between the cast iron liner 32 and steel shell 31, however, in static casting, the flux tends to float upward toward inward flange 33 and interferes with the fit or bonding of the cast iron with the steel shell. In this static casting process it appears preferable to preheat the steel shell 31 to approximately 500° F. in order to promote the flow of molten iron upward within the steel shell 31. The temperature of the steel shell 31 should generally be kept under 1000° F. The usual heating devices would either be gas torches or electrical induction heat.

After casting, the cores 40, 50, shell 31 and cast iron 32 are allowed to cool. Then the assembly is cleaned, typically by passing it through a vibrating process to shake the sand molds and sprues loose, followed by shot blasting. Then the cleaned composite brake drum is ready for the bonnet 35 to be welded on, if necessary, and for final machining for balance.

The composite steel shell brake drums resulting from the improved static casting process are found not to go out of round during casting so that the excess cast iron liner for finishing can be reduced from approximately one quarter inch to between about 0.09 to 0.120 inches per side, resulting in shorter finish times, less wasted iron, and better resulting balance for the finished drums. As previously indicated, the new process also enables the inward flange to be designed in a wider variety of shapes and permits the mounting section or bonnet to be rolled or welded onto the shell 31 prior to casting.

Numerous alterations of the methods herein described will suggest themselves to those skilled in the art. It will be understood that the details and arrangements of the methods that have been described and illustrated in order to explain the nature of the invention are not to be construed as any limitation of the invention, and all such alterations which do not depart from the spirit of invention are intended to be included within the scope of the intended claims.

I claim:

1. A method of static casting a composite brake drum comprising the steps of:

(a) providing a mold having a cylindrical side wall which will define an inner diameter;

(b) positioning a shell around said cylindrical side wall and thereby defining a cavity between said shell and said cylindrical side wall;

(c) heating said shell to between about 500° and 1000° F.;

(d) pouring molten iron alloy in the range of about 2550° to 2650° F. into the mold until the cavity is filled; and (e) cooling and cleaning the resulting composite brake drum.

2. The method according to claim 1 wherein the mold is comprised of an upper core and a lower core.

3. The method according to claim 1 wherein the mold further comprises a sprue, a turbulence chamber, and a plurality of in gates in communication between the turbulence chamber and the cavity.

4. The method according to claim 1 wherein the cylindrical side wall of the mold has an upper shoulder having at least one gas vent.

5. The method according to claim 1 wherein the shell is made of steel.

6. The method according to claim 1 wherein the shell is ribbed.

7. The method according to claim 1 wherein the shell is heated utilizing a gas burner.

8. The method according to claim 1 wherein the molten iron alloy is poured into the mold with an automatic pouring device.

9. A method of static casting a composite brake drum comprising the steps of:

(a) providing a mold having a sprue and a cylindrical side wall with an upper shoulder and at least one in gate in communication between said sprue and said cylindrical side wall, and further having a circular mounting ring outside said cylindrical side wall;

(b) positioning a shell having an open end and an opposed end so that the open end is aligned on the circular mounting ring and the opposed end is in contact with the upper shoulder of said cylindrical side wall, thereby defining a cavity between said shell and the cylindrical side wall;

(c) heating said shell to between about 500° and 1000° F.;

(d) pouring molten iron alloy in the range of about 2550° to 2650° F. into the sprue and thence through the in gate into the cavity until the cavity is substantially filled; and (e) cooling and cleaning the resulting casting.

10. The method according to claim 9 wherein the mold is comprised of an upper core and a lower core.

11. The method according to claim 9 wherein the mold further comprises a turbulence chamber between the sprue and the in gate.

12. The method according to claim 9 wherein the cylindrical side wall of the mold has an upper shoulder having at least one gas vent.

13. The method according to claim 9 wherein the shell is made of steel.

14. The method of claim 9 wherein the shell has ribs defining thicker portions of the cavity between the shell and the cylindrical side wall and at least one in gate is positioned opposite a thicker portion created by one such rib.

15. The method according to claim 9 wherein the shell is heated utilizing an induction heater.

16. The method according to claim 9 wherein the molten iron alloy is poured into the mold with an automatic pouring device.

17. A method of static casting a composite brake drum comprising the steps of:

(a) providing a base core having a turbulence chamber, a circular channel having inner and outer walls, and a plurality of in gates communicating between said turbulence chamber and said circular channel;

(b) providing a top core having a down sprue passing through said core and an outer cylindrical wall wherein said outer cylindrical wall has an upper shoulder with at least one gas vent;

(c) mounting said top core on said bottom core so that the down sprue is in alignment over the turbulence chamber and the outer cylindrical wall is aligned with the inner wall of the circular channel;

(d) positioning a shell having an open end and a flange end so that the open end rests on the outer wall of the circular channel and the flange end rests on the upper shoulder of the outer cylindrical wall, and thereby defines a cavity between the shell and the outer cylindrical wall;

(e) heating said shell to between about 500° and 1000° F.;

(f) pouring molten iron alloy in the range of about 2550° to 2650° F. into the down sprue so that the molten iron flows through the top core into the turbulence chamber, and thence through the plurality of gates into the circular channel and into the cavity defined by the cylindrical wall and the shell;

(g) venting gas from the cavity through at least one gas vent on the upper shoulder of the cylindrical wall;

(h) continuing to pour molten iron into the down sprue until the level of molten iron in the down sprue is at least the height of the upper shoulder of the cylindrical wall; and (i) cooling and cleaning the resulting casting.

18. The method of claim 17 wherein the inner wall of the circular chamber and the outer cylindrical wall of the upper core form a cylindrical side wall and the cavity filled by molten iron alloy is defined by the shell and the cylindrical side wall.

19. The method of claim 18 wherein the shell has ribs defining thicker portions of the cavity between the shell and the cylindrical side wall and at least one in gate is positioned opposite a thicker portion created by one such rib.

20. The method of claim 17 wherein the base core and top core are interlocking.

* * * * *